US005463850A

United States Patent [19]

Fukuda

[11] Patent Number: 5,463,850

[45] Date of Patent: Nov. 7, 1995

[54] LONGITUDINAL SEALER FOR PACKAGING MACHINE

[75] Inventor: Masao Fukuda, Shiga, Japan

[73] Assignee: Ishida Co., Ltd., Japan

[21] Appl. No.: 189,025

[22] Filed: Jan. 27, 1994

[30] Foreign Application Priority Data

Feb. 15, 1993 [JP] Japan ..... 5-048660
Nov. 25, 1993 [JP] Japan ..... 5-319096

[51] Int. Cl.[6] ..... B65B 51/26; B65B 51/16; B65B 51/18; B65B 9/08

[52] U.S. Cl. ..... 53/551; 53/374.4; 53/376.2

[58] Field of Search ..... 53/450, 451, 550, 53/551, 552, 374.4, 375.9, 376.2

[56] References Cited

U.S. PATENT DOCUMENTS 3,779,836 12/1973 Henry et al. ..... 53/551 X
4,084,999 4/1978 Rucker ..... 53/551 X
4,136,505 1/1979 Putnam, Jr. et al. ..... 53/551
4,219,988 9/1980 Shanklin et al. ..... 53/374.4 X
4,555,289 11/1985 Kreager ..... 53/551 X

*Primary Examiner*—Horace M. Culver
*Attorney, Agent, or Firm*—Majestic, Parsons, Siebert & Hsue

[57] ABSTRACT

A form-fill-seal type combined bag maker and packaging machine uses of a longitudinal sealer to seal together mutually overlapping side edges of an elongated bag-making material wrapped around a loading cylinder in a tubular form. The longitudinal sealer has a sealing unit with a heater supported by a mobile member which can be selectably moved linearly or rotationally such that the sealing unit can be not only correctly positioned but also properly oriented with respect to the loading cylinder currently installed on the packaging machine. The mechanism for moving the sealing unit is supported on an elongated member rotatably supported by the packaging machine so as to be easily moved away when the loading cylinder is removed and replaced by another of a different kind.

18 Claims, 7 Drawing Sheets

92
90
9-1
1
CONTROL
GAS CONTAINER
3
6
2
8
7
93
10
5
4
91
26
12
9
Y-DIRECTION
20
11
41
X-DIRECTION
28
30
53
27
21
23
25

LONGITUDINAL SEALER FOR PACKAGING MACHINE

BACKGROUND OF THE INVENTION

This invention relates to a longitudinal sealer of a form-fill-seal combined bag maker and packaging machine (hereinafter simply referred to as a packaging machine), and more particularly to a device for adjusting the position of a heater in such a sealer. The invention further relates to a packaging machine incorporating such an improved sealer.

Consider, for example, a so-called vertical pillow type packaging machine which uses a former to bend an elongated web of thermoplastic sheet into a tubular form, while pulling it down over the peripheral surface of a loading cylinder through which articles to be packaged are dropped. The mutually overlapping side edges of the tubularly formed sheet are sealed together by a heater in a vertical (or longitudinal) sealer, and a horizontal (or transverse) sealer disposed below the loading cylinder seals the top edge of a bag and the bottom edge of the next bag at the same time. The vertical sealer is usually provided with a vertically extended endless belt such that the filling and sealing of the bags can be carried out continuously.

Packaging machines of this type are required to be able to produce bags of different shapes and sizes, depending upon both the nature and the amount of the articles to be packaged. For this reason, many kinds of formers with different shapes and sizes are customarily provided and they are selectively used with a packaging machine. Japanese Patent Publication Tokkai 5-124606 discloses a packaging machine, of which the position of its sealing heater can be changed, depending on which of many available formers is installed. Since there are fluctuations in the shape and size of the formers due to production errors, the position of the sealer may require additional adjustments both in the radial and tangential directions. Moreover, the sealer may have to be tilted, even after it is correctly positioned, such that its tip will be accurately opposite to the surface of the former.

Thus, whenever a different former is installed for producing bags of a different kind, it becomes necessary not only to remove the endless belt and to adjust its position but also to carry out adjustments of the position of the sealing heater. In particular, since a prior art vertical sealer is usually so structured that its heater is axially supported by a shaft in its exterior, the tangential position of the tip of the heater with respect to the former is affected as the heater is rotated against this support shaft. The position adjustment of the heater is therefore made even more difficult to perform.

SUMMARY OF THE INVENTION

It is therefore an object of the invention to provide an improved longitudinal sealer for a packaging machine which can be adjusted easily and quickly according to the shape and the size of the bags to be formed.

It is another object of the invention to provide a compact device for adjusting the position and orientation of a sealer in such a longitudinal sealer.

It is an additional object of the invention to provide a packaging machine equipped with an improved longitudinal sealer having such a device for adjusting its heater position and orientation.

A longitudinal sealer embodying the present invention, with which the above and other objects can be achieved, may be characterized not only as comprising a sealing unit of an ordinary kind including a heater but also as having the sealing unit supported on a mobile member such that it can be moved by means of a unitized adjustment device not only in two mutually perpendicular directions but also selectably around an axis passing through the heater.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
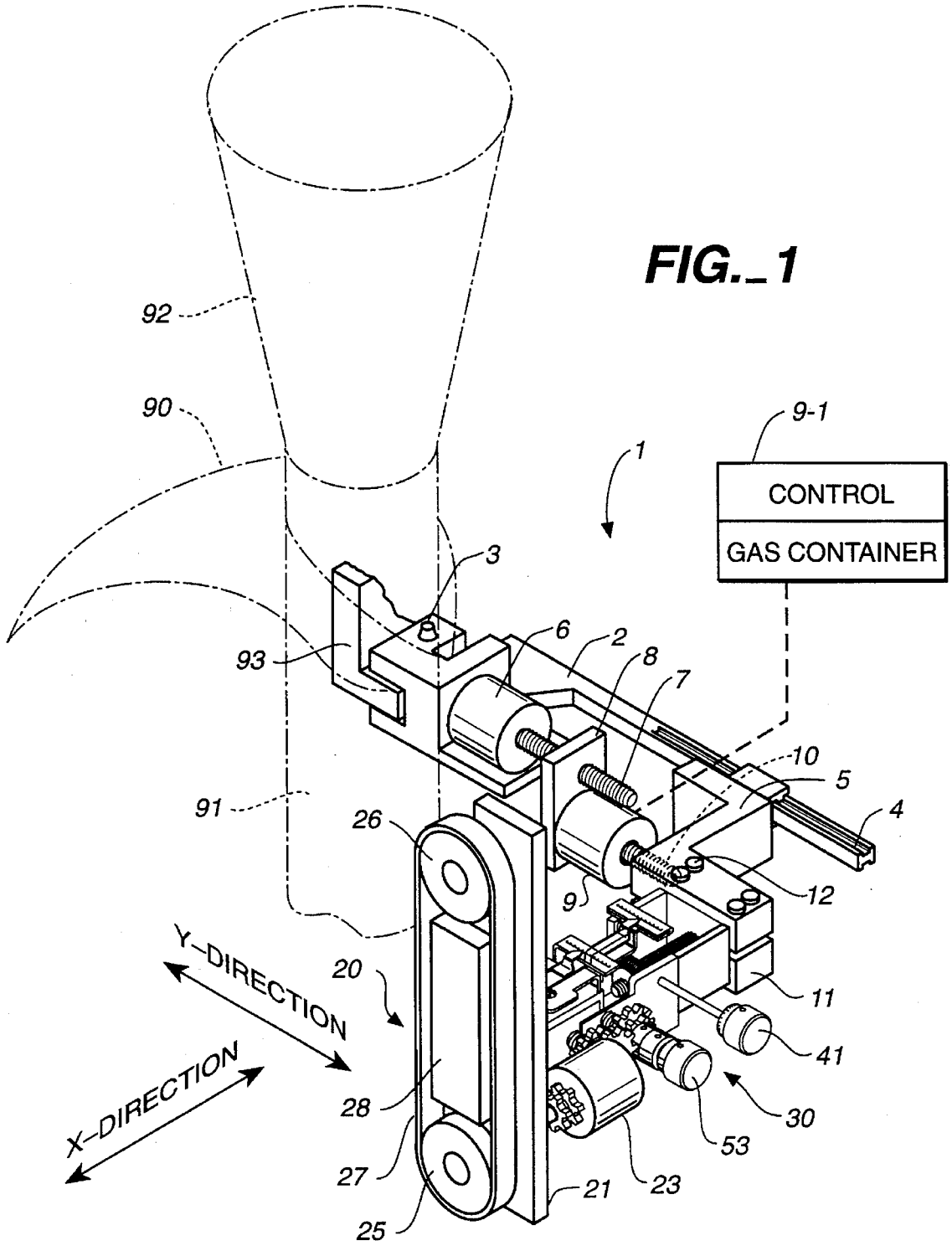
FIG. 1 is a diagonal view of a longitudinal sealer embodying the present invention as incorporated in a packaging machine.

In FIG. 1, numeral 1 generally indicates a longitudinal sealer according to this invention, as a part of a vertical pillow-type form-fill-seal packaging machine of an ordinary kind having a former 90, a loading cylinder 91 and a hopper 92 arranged in a well known relationship with respect to one another. In order that the former 90 can be easily removed and replaced by a different one, an elongated member (herein referred to as the arm 2) is rotatably supported by a frame 93 around a support pin 3 and the longitudinal sealer 1 is supported near the free end of the arm 2 such that it can be retracted out of the way of the former when it is exchanged. The arm 2 is provided with a guide groove 4 extending longitudinally therealong. A generally Z-shaped support block 5 is supported by the arm 2 and engages with this groove 4 so as to be able to slide longitudinally on and along the arm 2. One end of the support block 5 distal from the arm 2 is formed as a gripper 11 equipped with bolts 12 for supporting a sealer unit 20 by gripping an adjustment device 30 therefor. The arm 2 also supports a position-controlling motor 6 with a helically threaded shaft 7 for controlling the position of the support block 5 (in the Y-direction as indicated in FIG. 1) according to the size of the former 90 to be installed. The threaded shaft 7 of this motor 6 engages with a support table 8 supporting a cylinder 9 with a piston rod inside (of which the function will be described below).

The sealer unit 20 includes a base plate 21 extending parallel to the loading cylinder 91, a belt-driving motor 23 attached to the base plate 21, a driver pulley 25 mounted to the drive shaft of this motor 23, a follower pulley 26 axially supported by the base plate 21, an endless belt (or a seal belt) 27 stretched between the pulleys 25 and 26 so as to be rotated by the belt-driving motor 23, and a heater 28 disposed between the pulleys 25 and 26. Longitudinal sealing is effected by transmitting heat from the heater 28 through the belt 27 to mutually overlapping side edges of a bag-making sheet material (not shown) travelling downward along the outer peripheral surface of the loading cylinder 91.

Figure 2:
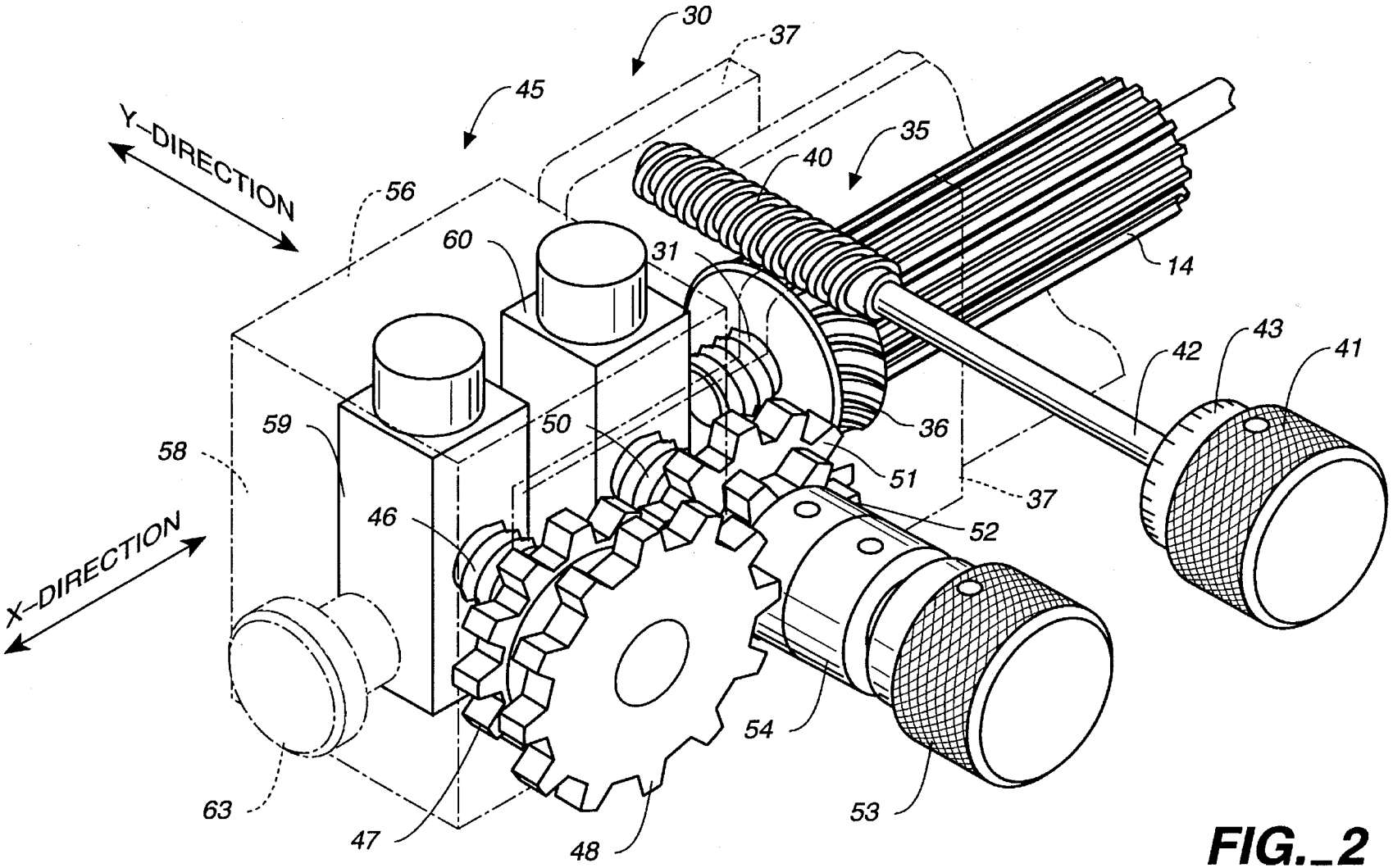
FIG. 2 is a diagonal view of a portion of the adjustment device in the longitudinal sealer of FIG. 1.
Figure 3:
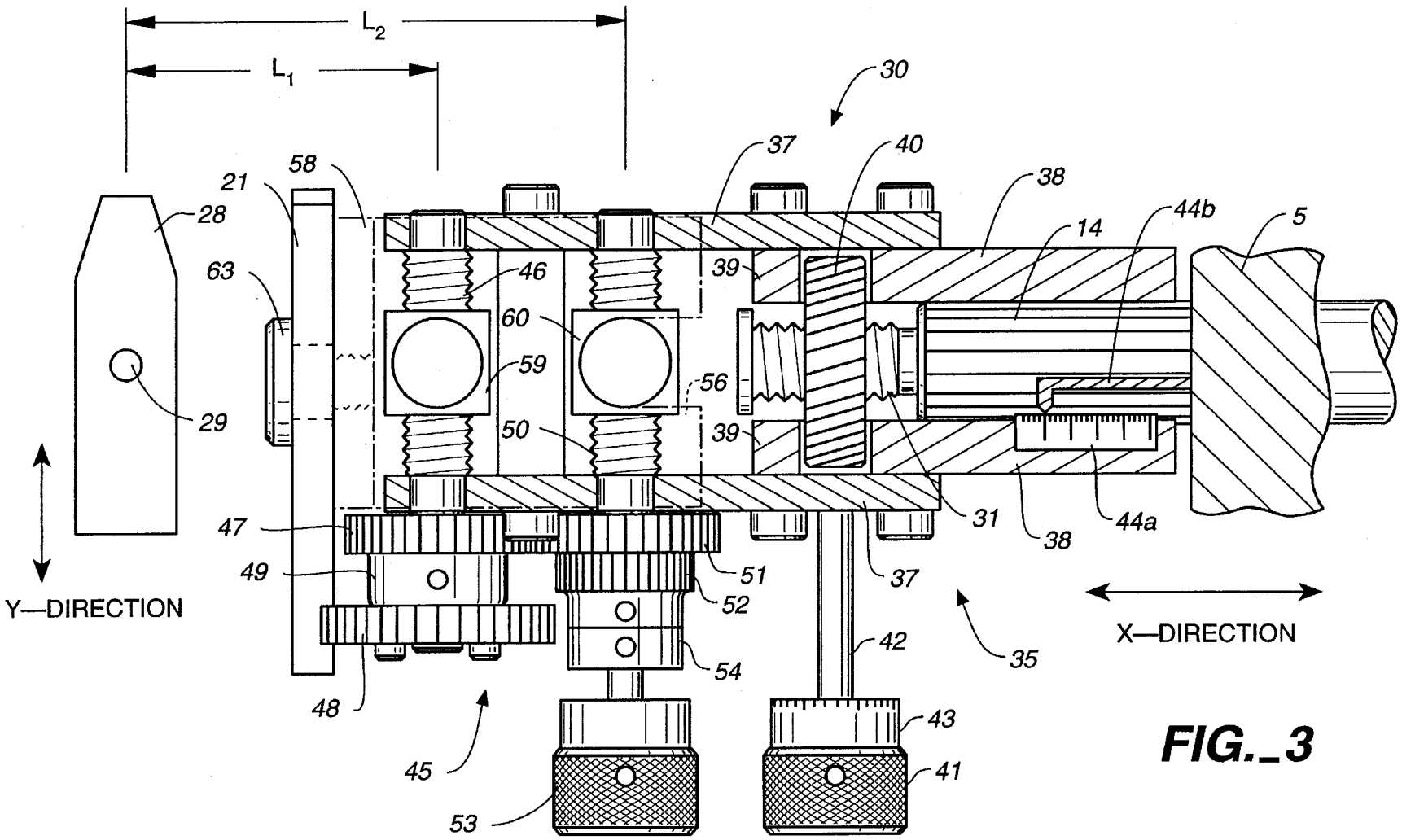
FIG. 3 is a partially sectional plan view of a portion of the adjustment device of FIGS. 1 and 2.
Figure 4:
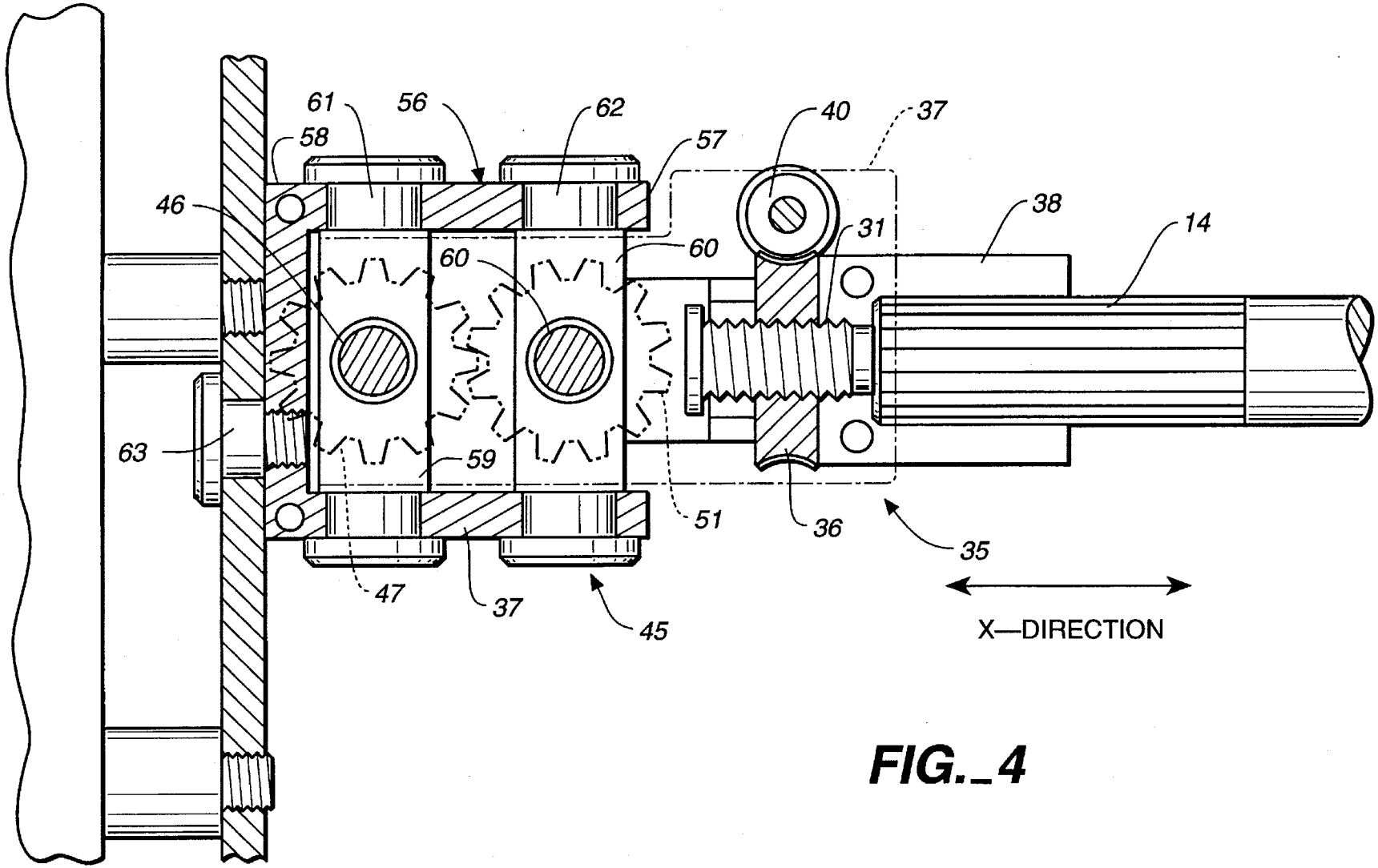
FIG. 4 is a partially sectional side view of a portion of the adjustment device of FIGS. 1–3.

As shown more clearly in FIGS. 2, 3 and 4, the adjustment device 30 is comprised of a first adjustment unit 35 for adjusting the position of the heater 28 in the X-direction (as indicated in FIGS. 2, 3 and 4) and a second adjustment unit 45 for adjusting both the position of the heater 28 in the Y-direction and its orientation. Numerals 37 indicate a pair of frame structures for the adjustment device 30 affixed to the base plate 21 of the sealer unit 20.

The first adjustment unit 35 includes a spline shaft 14, a worm wheel 36 and a worm gear 40. As shown most clearly in FIG. 3, the circumferential surface of the spline shaft 14 engages slidably with a mobile frame 38 which is affixed to the frame structures 37 of the device 30. A screw 31 is affixed to the front end of the spline shaft 14, and the worm wheel 36 is attached to the spline shaft 14 by engaging with the screw 31. The worm gear 40 is affixed to a shaft 42 which extends in the Y-direction and is supported rotatably by the frame structures 37 such that the worm gear 40 and the worm wheel 36 engage each other. Small flanking plates 39 are attached to inner surfaces of the frame structures 37 such that the worm wheel 36 is sandwiched between the front end of the mobile frame 38 and the flanking plates 39. A knob 41 with a calibration 43 is fastened to the shaft 42. As this knob 41 is rotated, the rotary motion of the worm gear 40 is communicated through the worm wheel 36, the spline shaft 14 and the mobile frame 38 and moves the frame structures 37, and hence also the second adjustment unit 45, in the X-direction, that is, in the tangential direction of the former 90. In order to show the actual displacement of the device 30 in the X-direction, a calibrated plate **44*a* is attached to the mobile frame 38 and an indicator 44*b* is affixed to a portion of the support block 5 such that the pointer of the indicator 44*b* will move along the calibrated plate 44*a***.

The second adjustment unit 45 is comprised basically of a pair of equally sized gear wheels and a pair of differently sized gear wheels and, which can be selectively engaged together for adjusting the position of the heater 28 in the Y-direction as well as its orientation. For this purpose, the frame structures 37 rotatably support a first shaft 46 and a second shaft 50 parallel to each other, extending in the Y-direction, with the first shaft 46 disposed closer to the heater 28. Both the first and second shafts 46 and 50 are helically threaded in mutually opposite directions. A portion of the first shaft 46 extends outside the frame structures 37, and a first gear wheel 47 and a second gear wheel 48 are affixed to this extended portion of the first shaft 46 with a spacer 49 disposed therebetween. Similarly, a portion of the second shaft 50 extends outside the frame structures 37, having a sleeve shaft 54 attached thereto so as to be slidable thereon and rotate therewith. A third gear wheel 51, a fourth gear when 52 and a knob 53 are attached to the sleeve shaft 54.

The first gear wheel 47 on the first shaft 46 and the third gear wheel 51 on the second shaft 50 are of the same size and engageable with each other. When these two gear wheels 47 and 51 are engaged to each other and rotate together, a mobile member 56, which is engaged to both the first and second shafts 46 and 50 respectively through engaging pieces 59 and 60, moves in the Y-direction. The second gear wheel 48 on the first shaft 46 and the fourth gear wheel 52 on the second shaft 50 are of different sizes so as to be also engageable with each other. Let $L_1$ and $L_2$ denote the distances respectively of the first and second shafts 46 and 50 from the heater 28 in the X-direction, as schematically shown in FIG. 3. The ratio between the diameters of the second and fourth gear wheels 48 and 52 is set equal to $L_2/L_1$ such that, when the gear wheels 48 and 51 are engaged to each other and rotate together, the mobile member 56 rotates around a vertical center axis 29 of the heater 28.

Figure 5:
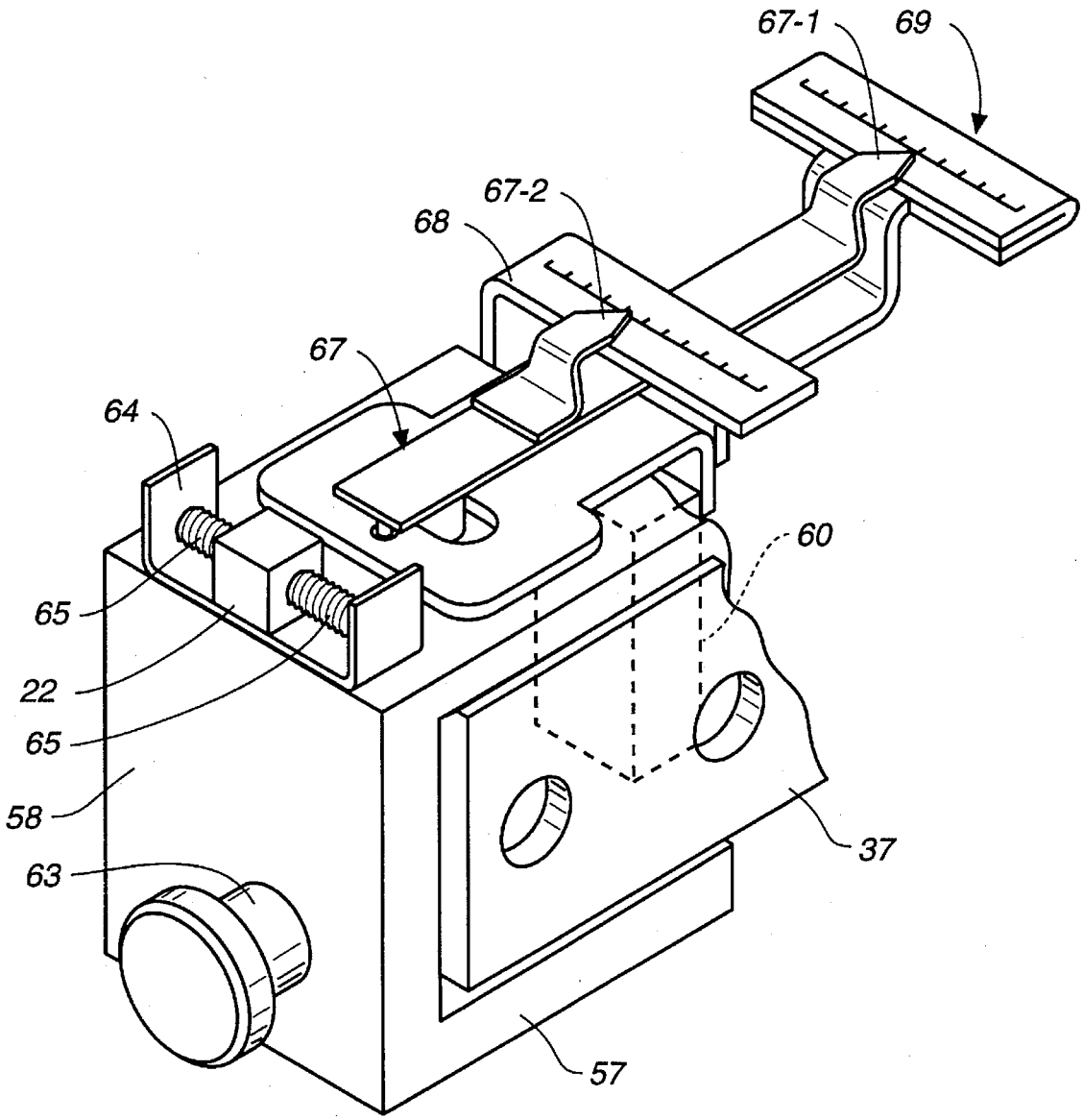
FIG. 5 is a diagonal view of the display mechanism of the adjustment device of FIGS. 1–4.

The mobile member 56 is cross-sectionally U-shaped, as seen sideways, with upper and lower horizontal plates 57 facing each other, as most clearly shown in FIGS. 4 and 5. The engaging pieces 59 and 60, engaging respectively to the first and second shafts 46 and 50, are sandwiched between these plates 57 and rotatably supported thereby around pins 61 and 62, respectively. The front end surface 58 of the mobile member 56 is provided with a support pin 63, by which the base plate 21 is axially supported. A U-shaped spring holder 64 is attached on top of the upper plate 57 as shown in FIG. 5. Numeral 22 in FIG. 5 indicates a protrusion from the base plate 21 (which itself is not shown in FIG. 5), sandwiched between a pair of springs 65 both attached to the spring holder 64 such that the angle of the sealer unit 20 in the Y-direction can be adjusted.

Figure 6:
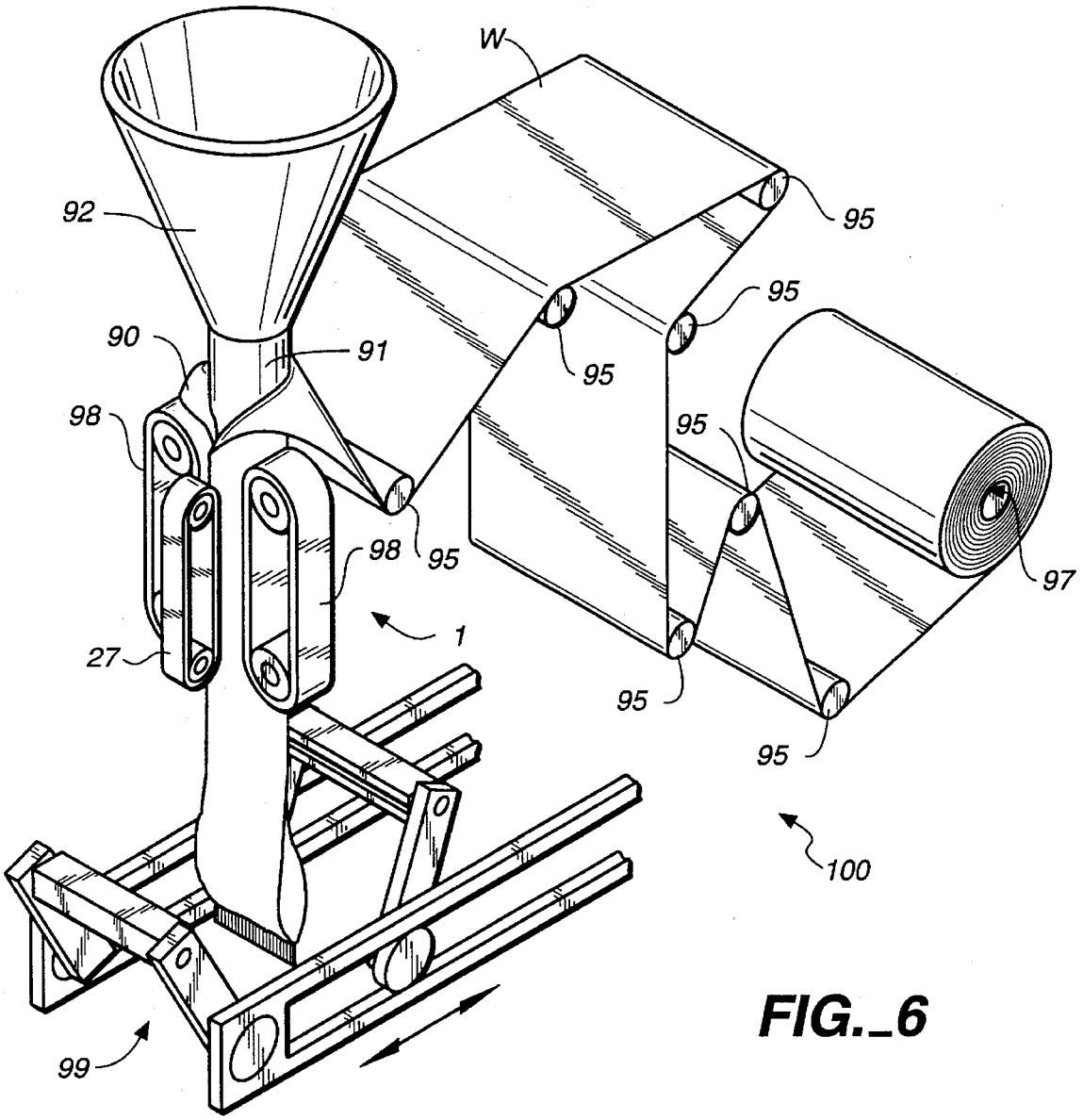
FIG. 6 is a schematic diagonal view of a portion of a vertical pillow type form-fill-seal bag maker-packaging machine incorporating a longitudinal sealer embodying the present invention.

FIG. 5 also shows a mechanism for displaying the adjustment made in the Y-direction as well as the orientation of the heater 28 by the second adjustment unit 45. A pointer 67 with its front end 67-1 pointing generally in the backward direction is attached to the top surface of the upper plate 57 of the mobile member 56, and a calibrated plate 68 for indicating the adjustment in the Y-direction is attached to and extended from one of the frame structures 37 such that a short indicator 67-2 attached to the pointer 67 and this calibrated plate 68 are proximal to each other. Another generally T-shaped calibrated plate 69 for indicating the angular adjustment is attached to a back surface of the engaging piece 60 (closer to the first adjustment unit 35) and its calibrated surface is positioned proximal to the front end 67-1 of the pointer 67. FIG. 6 shows a portion of a packaging machine 100, such as described in U.S. Pat. No. 5,279,098 issued Jan. 18, 1994 (which is incorporated herein by reference), comprised not only of a longitudinal sealer described above (of which only the seal belt 27 and its pulleys 25 and 26 are shown for simplicity), but also of a holder 97 for supporting a film supply roll, a plurality of guide rolls 95 for directing to the former 90 a web of flexible thermoplastic film material W pulled out of the film supply roll, a pair of pull-down belts 98 for pulling the film material W and a transverse sealer 99 disposed below the longitudinal sealer 1. With a packaging machine thus formed, the user first selects a roll of bag-making material (or film) and a loading cylinder of a proper size in view of the kind of bags to be made. After such a roll and loading cylinder are installed, the user specifies required conditions for the operation of the packaging machine 100 through an input device (not shown) such as a control panel. When the position-controlling motor 6 receives a signal indicative of such inputted data, it rotates accordingly so as to place the support block 5 properly (in the Y-direction) by way of the threaded shaft 7 with respect to the loading cylinder 91. The cylinder 9 is connected to a high-pressure gas container and a control device (schematically shown in FIG. 1 at 9-1), by means of which the piston rod 10 is pushed out or retracted into the cylinder 9 so as to maintain the sealer unit 20 at a wait position separated from the film by a specified distance. If it is desired to make bags with an off-center longitudinal sealing line, for example, the knob 41 attached to the worm wheel 40 is turned to move the mobile frame 38 and hence also the heater 28 in the X-direction, that is, tangentially with respect to the former 90.

Figure 7A:
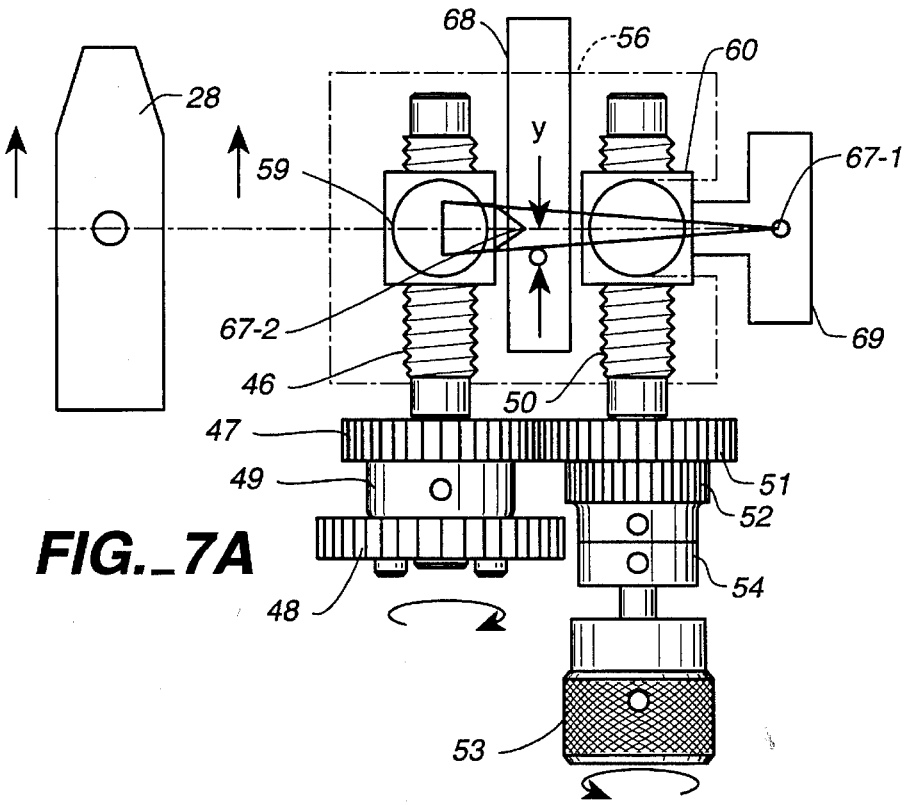
FIGS. 7(*a*) and 7(*b*) are plan views for showing operations of the adjustment device of FIGS. 1–5.
Figure 7B:
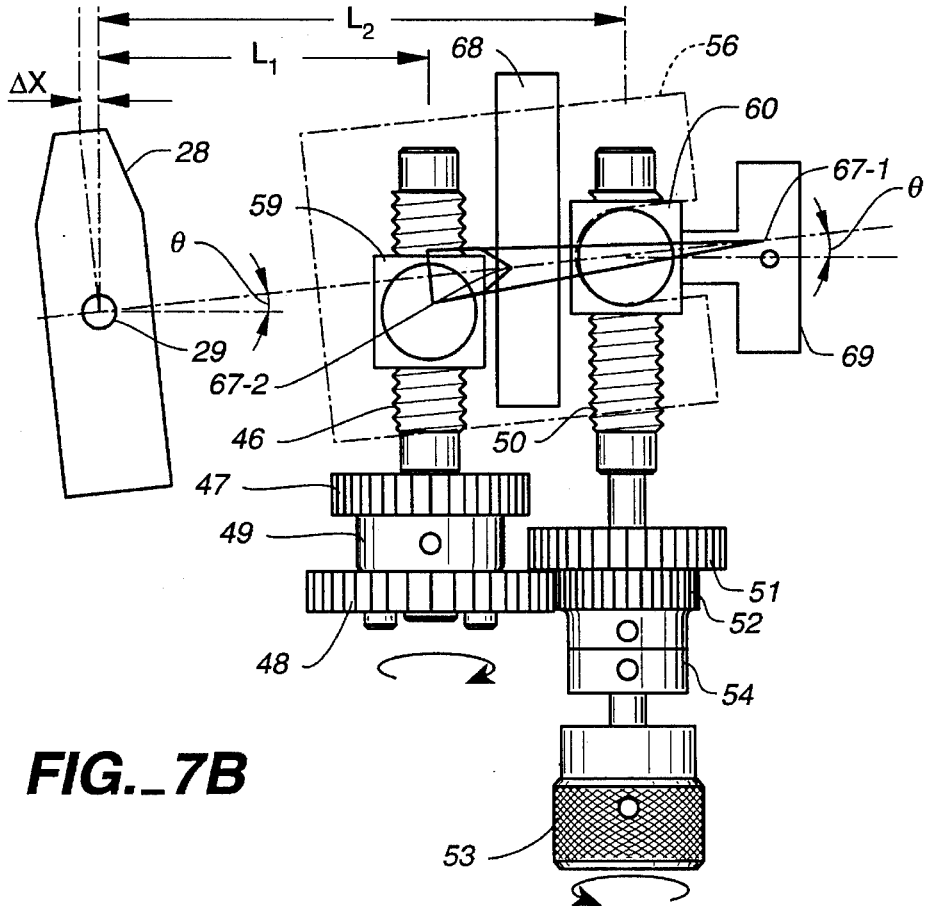

If the heater 28 and the former 90 are mismatched in the Y-direction, the other knob 53 on the second adjustment unit 45 is pushed in such that the pair of two equally sized gear wheels 47 and 51 is engaged together, as shown in FIG. 3, and then turned around in a correct direction. As a result, the shafts 46 and 50 cause the engaging pieces 59 and 60 to move in the same direction (Y-direction) at the same rate, as shown in FIG. 7(*a*), and the heater 28 is thereby translationally shifted in the Y-direction. In the meantime, the pointer 67 does not change its orientation and the calibrated plate 68 affixed to the frame structure 37 does not move in the Y-direction. The resulting relative displacement between the short indicator 67-2 attached to the pointer 67 and the calibrated plate 68 is indicated by y in FIG. 7(*a*).

If the tip of the heater 28 is not correctly facing the surface of the former 90, as shown in FIG. 7(*b*), the knob 53 is pulled out such that the pair of differently sized gear wheels 48 and 52 comes to be engaged with each other and then turned around in a correct direction. Because the numbers of teeth on the wheels 48 and 52 are inversely proportional to the ratio between the distances $L_1$ and $L_2$ of their axes from the heater 28, the mobile member 56 rotates around the center axis 29 of the heater 28, as shown in FIG. 7(*b*), thereby changing the orientation of the heater 28 attached to its front surface 58 until the tip of the heater 28 exactly matches the surface of the former 90. As the heater 28 is thus rotated around its axis 29 by a small angle θ, its tip will be displaced by a small distance Δx in the X-direction, as shown in FIG. 7(*b*), but this distance Δx is negligibly small for all practical purposes.

In the meantime, the pointer 67 rotates with the mobile member 56 on which it is affixed. The T-shaped angle-indicating plate 69, on the other hand, is affixed to the engaging piece 60 on the shaft 50, and hence its orientation remains the same as the engaging piece 60 moves in the Y-direction. Thus, there is a relative motion between the front end 67-1 of the pointer 67 and the calibrated plate 69, and it is displayed as the angular adjustment.

In summary, the mobile frame, which supports the longitudinal seal unit, itself is adjustably movable both in the Y-direction and around an axis of the seal unit. As a result, the displacement in the X-direction becomes practically negligible, although adjustments in the X-direction can be carried out independently, and the operation for adjustment becomes much simplified according to the present invention.

What is claimed is:

1. A longitudinal sealer for a packaging machine, comprising:

a sealing unit including a heater;

a mobile support member supporting said sealing unit; and

Y-θ adjusting means for selectably moving said support member linearly in a specified Y-direction or rotating said support member around a vertical axis through said sealing unit.

2. The longitudinal sealer of claim 1 wherein said Y-θ adjusting means is unitized with said mobile support member and comprises:

a mutually parallel pair of shafts extending both in said Y-direction; and switching means for selectably causing said pair of shafts to rotate at a same rate or at different rates proportional to the distance from said sealing unit;

said mobile support member supporting said sealing unit at one end thereof in X-direction perpendicular to said Y-direction and being connected with said pair of shafts through engaging means engaging with said shafts.

3. The longitudinal sealer of claim 2 wherein said Y-θ adjusting means further comprises:

a frame structure which rotatably supports said pair of shafts;

a first calibrated member affixed to said frame structure;

a second calibrated member affixed to an engaging member engaged with one of said shafts; and an indicator affixed to said mobile support member, said indicator having a first pointer adapted to swing along said first calibrated member and a second pointer adapted to swing along said second calibrated member.

4. The longitudinal sealer of claim 2 wherein said adjusting means further comprises:

a frame structure which rotatably supports said pair of shafts;

a first calibrated member affixed to said frame structure;

a second calibrated member affixed to one of said engaging means engaged with one of said shafts; and an indicator affixed to said mobile support member, said indicator having a first pointer adapted to move along said first calibrated member and a second pointer adapted to move along said second calibrated member.

5. The longitudinal sealer of claim 1 further comprising X adjusting means engaging with a part of said Y-θ adjusting means for causing said Y-θ adjusting means to move in X-direction which is perpendicular to said Y-direction.

6. The longitudinal sealer of claim 5 wherein said Y-θ adjusting means includes a frame structure, and said X adjusting means is unitized, said X adjusting means comprising a helically threaded X-directional shaft extending in said X-direction, a rotary member engaging with and being adapted to rotate on said X-directional shaft and a knob means for causing said rotary member to rotate.

7. The longitudinal sealer of claim 6 wherein said knob means is calibrated so as to display a displacement of said Y-θ adjusting means in said X-direction.

8. The longitudinal sealer of claim 5 further comprising an elongated member rotatably supported by said packaging machine, said elongated member supporting said Y-θ adjusting means and said X-adjusting means.

9. The longitudinal sealer of claim 1 wherein said Y-θ adjusting means serves to move said sealing unit radially towards or away from a loading cylinder installed on said packaging machine for allowing articles to pass therethrough to be packaged in bags.

10. A longitudinal sealer for a packaging machine having a loading cylinder installed thereon, said longitudinal sealer comprising:

a sealing unit including a heater;

a first adjusting means for adjustingly moving said sealing unit radially towards or away from said loading cylinder;

a second adjusting means for adjustingly moving said sealing unit tangentially with respect to said loading cylinder;

a control means for selectably pressing said sealing unit against a bag-making material on said loading cylinder or moving said sealing unit away from said bag-making material;

a tilting means for adjusting the angular orientation of said sealing unit with respect to the axial direction of said loading cylinder; and an elongated member rotatably supported by a frame structure of said packaging machine, said elongated member supporting said first and second adjusting means, said control means and said tilting means through a supporting block.

11. The longitudinal sealer of claim 10 further comprising a motor means for causing said supporting block to slide longitudinally on said elongated member.

12. A packaging machine comprising:

a loading cylinder for causing articles to pass therethrough to be packaged in bags;

a film supporting means for supporting a roll of bag-making material;

pulling means for pulling said bag-making material from said roll;

a former for forming said bag-making material into a tubular shape around said loading cylinder;

film guiding means for guiding said bag-making material to said former;

a longitudinal sealer for sealing side edges of said tubularly formed bag-making material together; and a transverse sealer for sealing said tubularly formed bag-making material transversely to the direction of motion thereof;

said longitudinal sealer comprising:

a sealing unit including a heater;

a mobile support member supporting said sealing unit; and

Y-θ adjusting means for selectably moving said support member linearly in a specified horizontal Y-direction or rotating said support member around a vertical axis through said sealing unit.

13. The packaging machine of claim 12 wherein said Y-θ adjusting means is unitized with said mobile support member and comprises:

a mutually parallel pair of shafts extending both in said Y-direction; and switching means for selectably causing said pair of shafts to rotate at a same rate or at different rates proportional to the distance from said sealing unit;

said mobile support member supporting said sealing unit at one end thereof in X-direction perpendicular to said Y-direction and being connected with said pair of shafts through engaging means engaging with said shafts.

14. The packaging machine of claim 12 wherein said Y-θ adjusting means further comprises:

a frame structure which rotatably supports said pair of shafts;

a first calibrated member affixed to said frame structure;

a second calibrated member affixed to an engaging member engaged with one of said shafts; and an indicator affixed to said mobile support member, said indicator having a first pointer adapted to swing along said first calibrated member and a second pointer adapted to swing along said second calibrated member.

15. The packaging machine of claim 12 further comprising X adjusting means engaging with a part of said Y-θ adjusting means for causing said Y-θ adjusting means to move in X-direction which is perpendicular to said Y-direction.

16. The packaging machine of claim 15 wherein said Y-θ adjusting means includes a frame structure, and said X adjusting means is unitized, said X adjusting means comprising a helically threaded X-directional shaft extending in said X-direction, a rotary member engaging with and being adapted to rotate on said X-directional shaft and a knob means for causing said rotary member to rotate.

17. The packaging machine of claim 16 wherein said knob means is calibrated so as to display a displacement of said Y-θ adjusting means in said X-direction.

18. The packaging machine of claim 15 further comprising an elongated member rotatably supported by said packaging machine, said elongated member supporting said Y-θ adjusting means and said X-adjusting means.

* * * * *